US005427168A

United States Patent [19]

Lohausen

[11] Patent Number: 5,427,168

[45] Date of Patent: Jun. 27, 1995

[54] MOUNTING FOR ARTICULATED-ARM AWNINGS

[76] Inventor: Viktor Lohausen, Am Lerchenberg 28, 7101 Oberheinriet, Germany

[21] Appl. No.: 94,093

[22] PCT Filed: Jan. 28, 1991

[86] PCT No.: PCT/EP91/02382

§ 371 Date: Jul. 28, 1993

§ 102(e) Date: Jul. 28, 1993

[87] PCT Pub. No.: WO92/13152

PCT Pub. Date: Aug. 6, 1992

[30] Foreign Application Priority Data

Jan. 28, 1991 [DE] Germany ..... 41 02 363.3

[51] Int. Cl.[6] ..... E04F 10/06

[52] U.S. Cl. ..... 168/66; 160/22

[58] Field of Search ..... 160/22, 66, 70, 79

[56] References Cited

U.S. PATENT DOCUMENTS

| | | | |
|---|---|---|---|
| 1,681,016 | 8/1928 | Schmidt . | |
| 2,695,763 | 11/1954 | Azzo . | |
| 4,469,159 | 9/1984 | Lohausen | 160/22 |
| 4,733,683 | 3/1988 | Pozzi | 160/22 |
| 5,273,095 | 12/1993 | Lukos | 160/70 |

FOREIGN PATENT DOCUMENTS

| | | |
|---|---|---|
| 1545852 | 10/1968 | France . |
| 2514941 | 10/1976 | Germany . |
| 2635287 | 2/1978 | Germany . |
| 3207399 | 9/1983 | Germany . |
| 3708155 | 9/1988 | Germany . |
| 66365 | 1/1973 | Luxembourg . |

*Primary Examiner*—Blair M. Johnson

[57] ABSTRACT

The invention concerns a mounting for articulated-arm awnings, the mounting having at least one bracket (1) and at least one single-part or multi-part support arm (2) attached to the bracket. The support arm has an internal space designed to accommodate a spindle holding the awning cloth or a casing enclosing a spindle holding the awning cloth. The mounting is characterized in that the lower edge of the bracket (1) has in it a downwards-facing groove (3) designed to permit attachment bolts to enter and able to accommodate at least one threaded nut (4). The lower rear section of the support arm has a rearwards-protruding flange (5) with a bore (6) designed to accommodate fixation bolts (7) screwed into the nut (4).

9 Claims, 5 Drawing Sheets

MOUNTING FOR ARTICULATED-ARM AWNINGS

The invention relates to a mounting for articulated-arm awnings according to the preamble of claim 1.

Mountings of this type are widely known. However, it has been found that such mountings are often not easy to mount and in particular often consist of too many individual parts which make mounting inconvenient and time-consuming.

This applies very generally but in particular to cassette awnings.

It is the object of the invention no simplify a mounting of the type stated at the outset so that it consists of as few parts as possible and is also simple to mount.

This object of the invention is achieved if the lower side of the bracket has a groove open downward for the passage of attachment bolts and intended to receive at least one nut provided with threaded holes, and if the rear lower end section of the support arm has a backward-protruding flange with a bore for receiving retaining bolts which can be screwed into the nut.

Further features of the invention are described in the further claims.

The invention is now illustrated in detail with reference to embodiments in conjunction with the attached drawings:

In the drawings,

FIG. 1 shows a mounting assembled according to the invention and intended preferably for cassette awnings having a bracket 1 which, for example, may be up to 20 cm wide or more. Of course, two or more such brackets or a common continuous bracket 1 may be provided if required.

Figure 1:
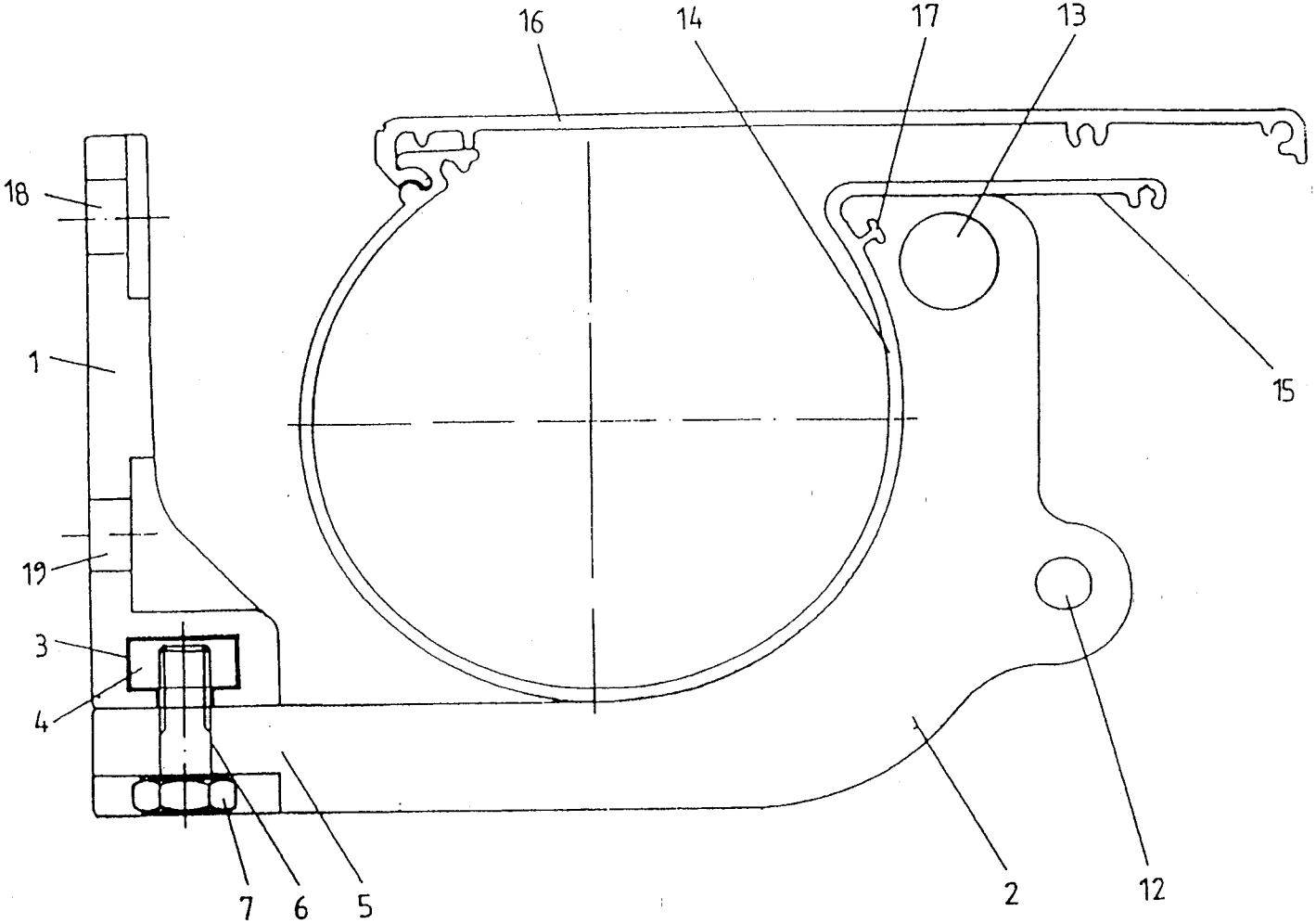
FIG. 1 shows a mounting for a cassette awning according to the invention.

A support arm 2 which forms an internal space which is at least partly arc-shaped is attached to this bracket.

The lower side of the bracket has a preferably T-shaped groove 3 which is open downward for the passage of attachment means, preferably attachment bolts, and into which, for example, a nut 4 can be inserted. Of course, this nut may extend over the entire width of the bracket. On the other hand, a number of nuts may also be provided. It is also possible for this groove having an approximately T-shaped cross-section to be open only on one side of the bracket.

For its attachment as a mounting, the rear end of the support arm 2 has a flange 5 in which, depending on the width of the support arm, one or more bores 6 are provided, through which a retaining bolt 7 can be screwed into the nut 4. The bore 6 is preferably in the form of a stepped bore so that the bolt head of the retaining bolts 7 does not project. It is particularly advantageous if at least part of the bore 6 carries an internal thread so that, prior to assembly, the retaining bolt 7 can be screwed in, substantially facilitating the assembly.

A holding device 12 which is only indicated and is intended for an articulated arm and a holding device 13 which is likewise only indicated and is intended for a tilting joint are furthermore recognizable on the support arm 2. Holding devices and attachment devices for articulated arms and tilting joints are not part of the present invention.

A sleeve or casing 14 which ends at the front in a guide plate 15 is inserted into the support arm or into the support arms. A roof 16 which covers the sleeve or casing at the top is also provided. The casing is furthermore attached to the support arm 2 by means of an attachment device 17 which is only indicated. This may be, for example, one or more T-shaped projections which can be pushed into corresponding slots in the support arm 2.

The bracket can be attached by means of bolts—not shown—at holes 18 and 19 for wall attachment. These holes too are preferably in the form of stepped holes. Here too, it appears expedient to provide a few thread turns at least in part of the hole to facilitate mounting.

As shown by tests performed, this type of attachment of one or more support arms to brackets is already very stable and in many cases sufficient for holding a cassette awning.

Figure 2:
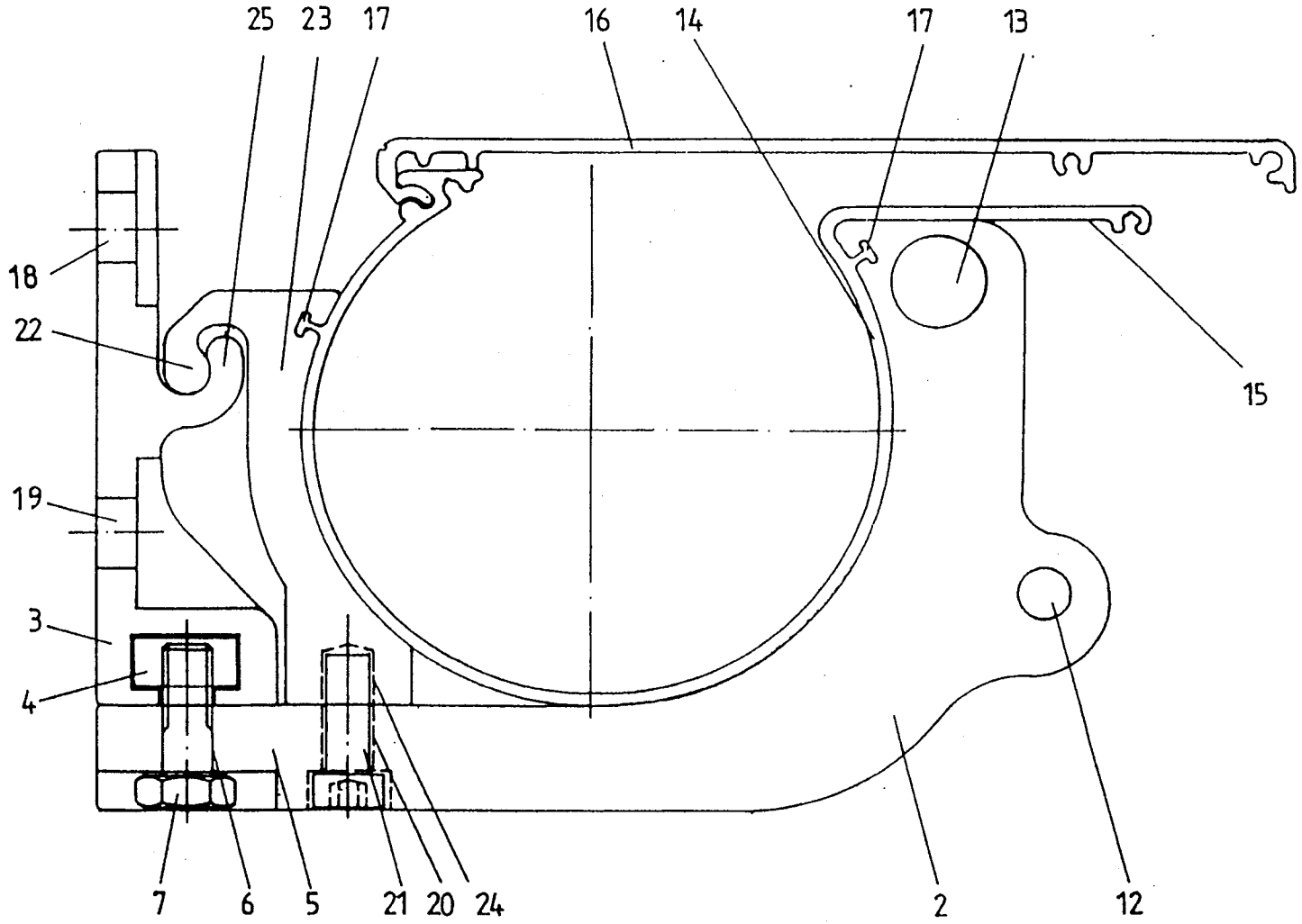
FIG. 2 shows a schematic cross-sectional view of a further embodiment of the mounting.

As shown in FIG. 2, this design can be even further improved. Identical parts are once again denoted by the same reference symbols as in FIG. 1.

The support arm 2 now has a second bore 20 which is located further forward and into which a further retaining bolt 21 can be inserted. This bore too is preferably in the form of a stepped bore and, here too, it is expedient to provide at least part of the bore with a thread. To supplement the construction shown in FIG. 1, an adapter 23 whose lower side has a threaded hole 24 into which the retaining bolt 21 can be screwed is provided here. Of course, a T-shaped groove for receiving a nut provided with a threaded hole could also be provided at this point.

This adapter could, for example, occupy the entire width of the support arm.

A retaining strip 22 which is approximately hook-shaped is provided on the back of this adapter. A complementary, likewise hook-shaped retaining strip 25 into which the adapter 23 can be hooked with its retaining strip 22 is provided on the front of the bracket 1.

As can be clearly seen from FIG. 2, the hook-shaped retaining strips are thicker at their end edges. Their shapes are adapted to one another in such a way that a secure connection is produced between the adapter 23 and the bracket 1.

The front of the adapter completes the contour of the internal space, forming a virtually circular cross-section into which the casing 14 can be inserted, the adapter having a further attachment device 17. Any further similar attachment means may be provided.

Figure 3:
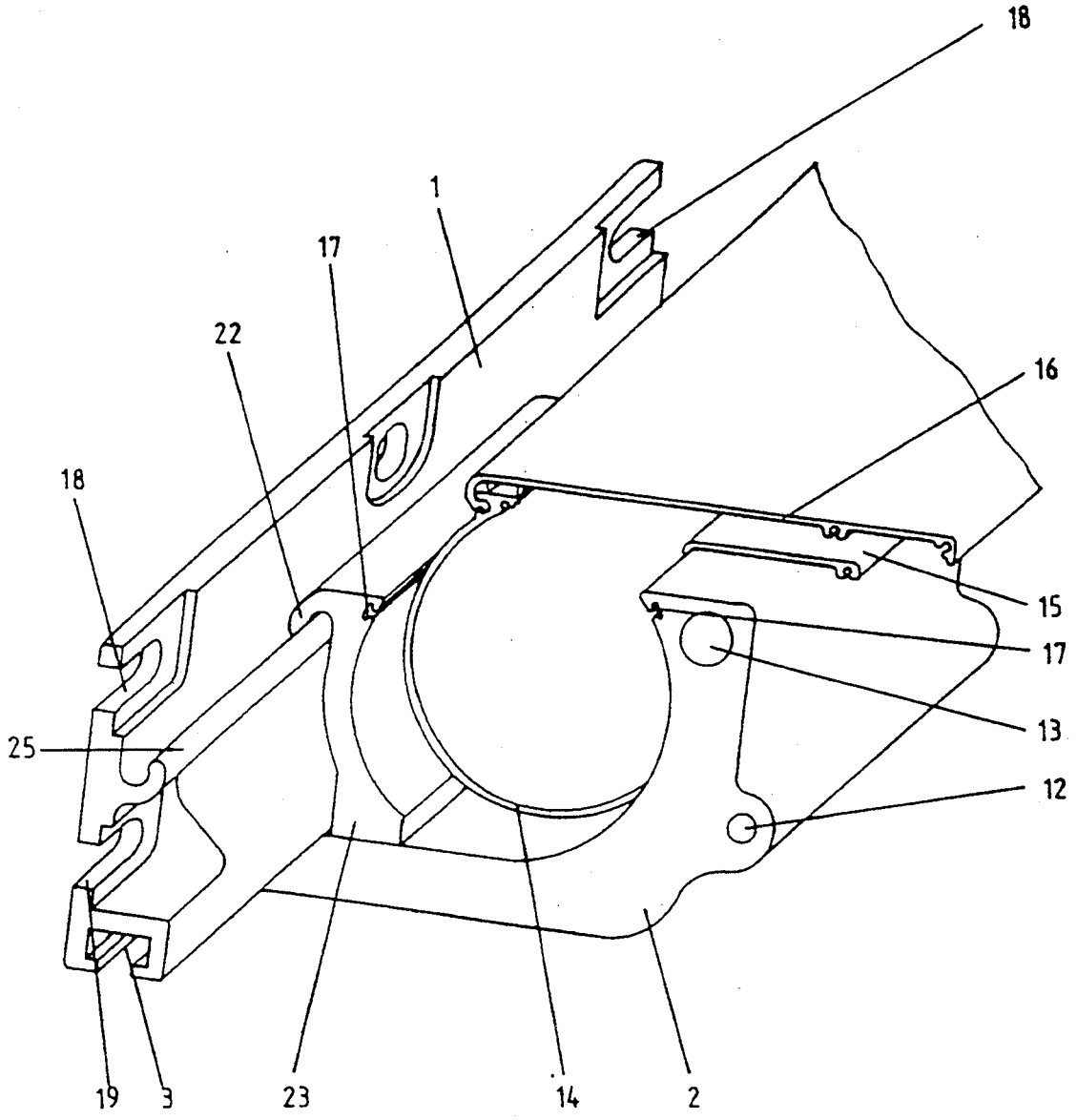
FIG. 3 shows a schematic perspective partial view of the mounting according to FIG. 2.

FIG. 3 shows a partly perspective view of the mounting according to FIG. 2, identical parts being provided with the same reference symbols. The shape of the bracket 1 with the support arm 2 and the adapter 23 attached thereto, which grips with its retaining strip 22 behind the retaining strip 25 of the bracket 1 and is attached to the latter can be clearly seen.

Further explanations of this drawing are not required.

Figure 4:
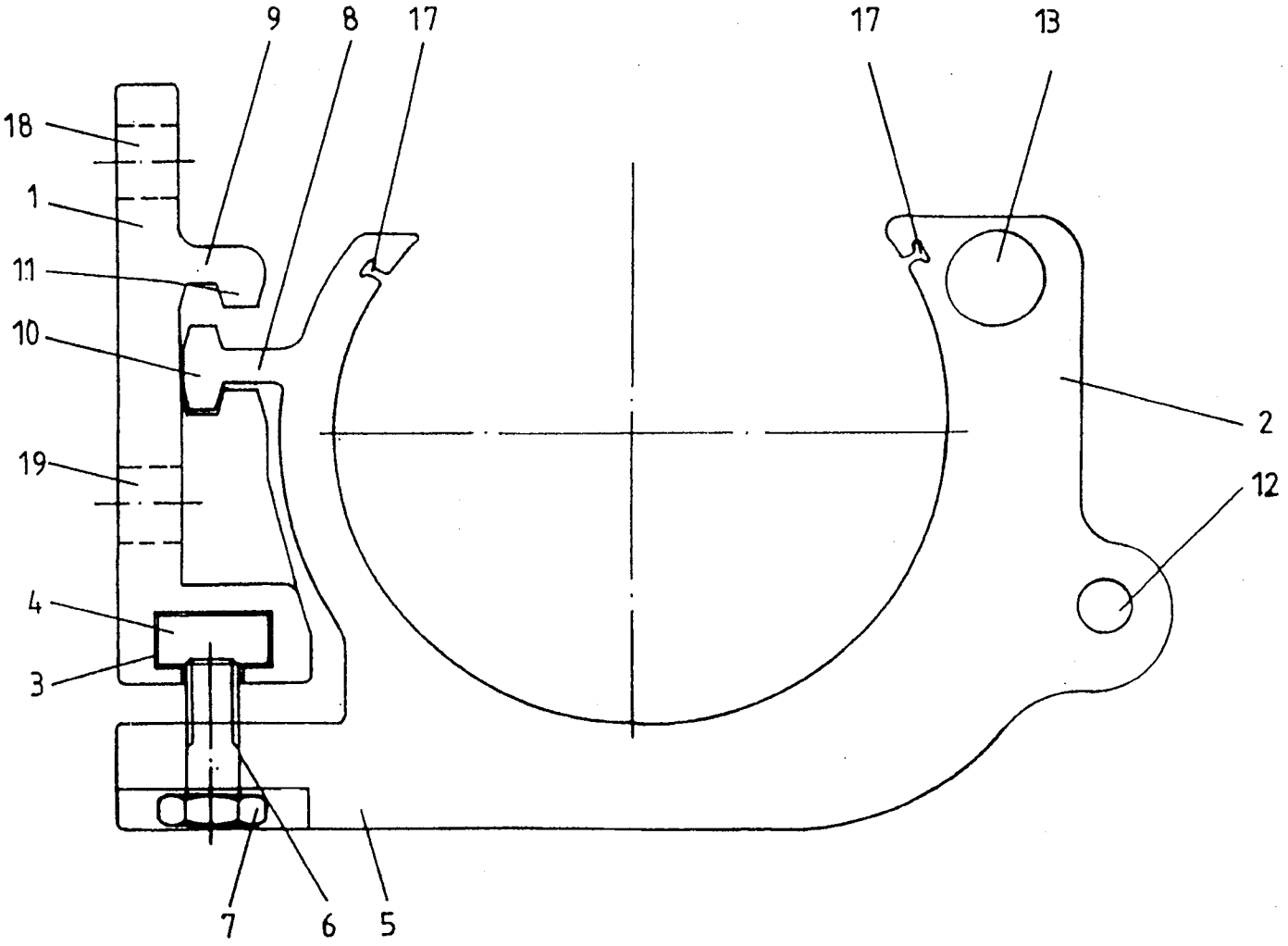
FIG. 4 shows a schematic sectional view of a further embodiment of the mounting at the beginning of assembly and FIG. 5 shows the assembled mounting according to FIG. 4.

This already very good design can be even further improved, as shown in detail in FIG. 4, in which identical parts are once again provided with the same reference symbols. The remarks made in connection with FIGS. 1 to 3 regarding the attachment of the support arm or support arms to the bracket 1 with the aid of retaining bolts 7 which are arranged in a nut 4 within a preferably T-shaped groove 3 also apply to this representation.

The support arm 2 now has an approximately hammerhead-shaped mounting strip 8 on its back. A mounting rail 9 set slightly higher is provided on the front of the bracket 1. In the diagram shown here, the mounting strip 8 rests on an approximately trapezoidal projection on the front of the bracket 1. The mounting strip 8 has a locating strip 10 which has an also approximately trapezoidal cross-section corresponding to the cross-section of the locating strip 11 of the mounting rail 9, which cross-section is likewise trapezoidal.

Figure 5:
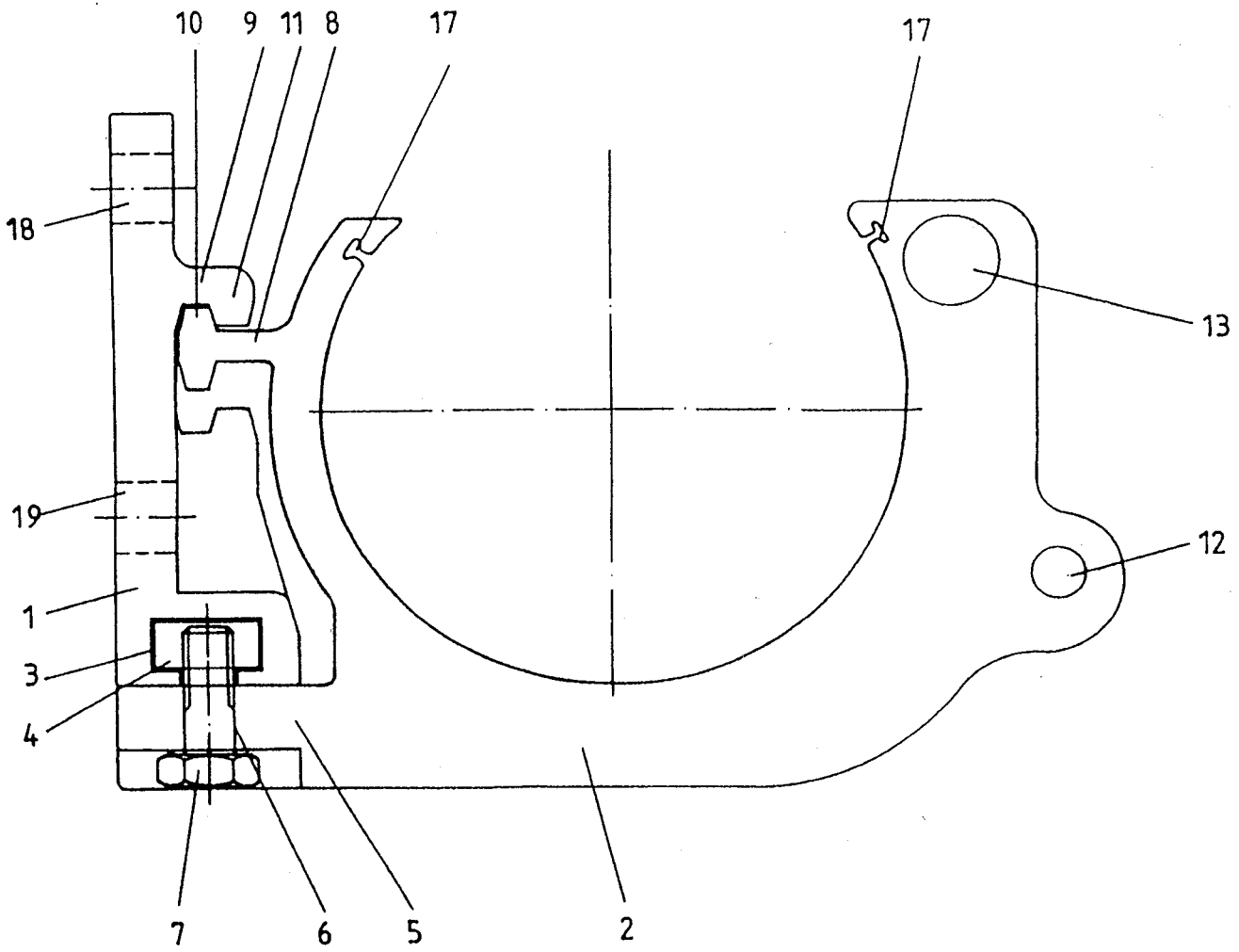

As is evident in detail in FIG. 5, screwing in and tightening the retaining bolt 7 forces the support arm 2 upward so that the locating strips 10 and 11 come into contact with one another at their bevels. This results in the support arm 2 being drawn tightly against the bracket 1. Consequently, there is an extremely rigid connection between bracket and support arm.

It should also be noted that, in FIG. 5 too, the same parts are provided with the same reference symbols.

Although the design shown in FIG. 1 can be made sufficiently stable for many cases, the design according to FIGS. 2 and 3 is capable of withstanding even the greatest loads.

Similarly, the design according to FIG. 4 and 5, developed from the design according to FIG. 1 to 3, is also stable but has fewer components and is in general suitable even for the greatest loads. It should always be noted that of course—depending on requirements—a plurality of brackets and a plurality of support arms may be provided without altering anything with regard to the principle of the design and its technical applicability.

I claim:

1. A mounting for articulated-arm awnings having at least one bracket and at least one support arm which can be attached to the bracket and encloses an internal space for a cloth shaft with an awning cloth, wherein a lower side of the bracket has a groove open downward for the passage of attachment bolts and intended to receive at least one nut provided with threaded holes, wherein a rear lower end section of the support arm has a backward-protruding flange with a bore for receiving retaining bolts which can be screwed into the nut, wherein furthermore the support arm has a further bore for receiving a further retaining bolt in front of the bore arranged in the flange, wherein the front of the bracket has an approximately hook-shaped retaining strip and wherein an adapter is provided whose lower side has a bore for receiving the further retaining bolt and whose back is provided with a retaining strip which is likewise approximately hook-shaped and can be hooked into the retaining strip of the bracket.

2. A mounting as claimed in claim 1, wherein an internal space for holding the awning is approximately circular and is formed by the support arm extending approximately up to the central axis of this internal space and from there by a contour of the front portion of the adapter.

3. A mounting as claimed in claim 1, wherein the front of the support arm has a holding device for a tilting joint.

4. A mounting as claimed in claim 1, wherein the front of the support arm has a holding device for at least one articulated arm.

5. A mounting for articulated-arm awnings having at least one bracket and at least one support arm which can be attached to the bracket and encloses an internal space for a cloth shaft, wherein a lower side of the bracket has a groove open downward for the passage of attachment bolts and intended to receive at least one nut provided with threaded holes, wherein a rear lower end section of the support arm has a backward-protruding flange with a bore for receiving a retaining bolt which can be screwed into the nut, wherein the support arm has, on its back, a mounting strip having an approximately T-shaped cross-section and a mounting rail having an approximately T-shaped cross-section and into which the mounting strip of the support arm can be hooked is provided on the front of the bracket opposite the mounting strip, the support arm forming nearly the total of said internal space approximately in the shape of an arc for the awning.

6. A mounting as claimed in claim 5, wherein locating strips of the mounting rail and of the mounting strip each have an approximately wedge-shaped cross-section.

7. A mounting as claimed in claim 6, wherein the front of the support arm has a holding device for a tilting joint.

8. A mounting as claimed in claim 5, wherein the front of the support arm has a holding device for at least one articulated arm.

9. A mounting as claimed in any of claims 1, 2, 3, 4, 5, 6, 7 or 8, wherein an approximately arc-shaped internal space of the at least one support arm has attachment means for an awning casing.

* * * * *